United States Patent [19]

Daussan et al.

[11] Patent Number: 4,799,652

[45] Date of Patent: Jan. 24, 1989

[54] LINING FOR PROTECTING THE INTERIOR OF A METALLURGICAL VESSEL AND A METHOD FOR FORMING SAID LINING

[75] Inventors: Jean-Charles Daussan, Marcel-Metz; Gérard Daussan; André Daussan, both of Longeville-les-Metz, all of France

[73] Assignee: Daussan et Compagnie, Woippy, France

[21] Appl. No.: 888,484

[22] Filed: Jul. 23, 1986

[30] Foreign Application Priority Data

Jul. 24, 1985 [FR] France ..... 85 11327

[51] Int. Cl.[4] ..... C21B 3/00

[52] U.S. Cl. ..... 266/275; 266/286; 264/30

[58] Field of Search ..... 266/280, 286, 275, 236, 266/45, 44, 281, 283, 284; 264/30

[56] References Cited

U.S. PATENT DOCUMENTS

| | | | |
|---|---|---|---|
| 1,381,171 | 6/1921 | Darrah | 266/275 |
| 3,345,059 | 10/1967 | Swindt | 266/280 |
| 4,012,029 | 3/1977 | Seguin et al. | 266/275 |
| 4,055,336 | 10/1977 | Massin | 266/275 |
| 4,202,538 | 5/1980 | Shimada et al. | 266/275 |
| 4,339,115 | 7/1982 | Daussan et al. | 266/280 |
| 4,422,625 | 12/1983 | Thurn | 266/275 |
| 4,468,012 | 8/1984 | Daussan et al. | 266/275 |
| 4,480,820 | 11/1984 | Zhukov et al. | 266/281 |

FOREIGN PATENT DOCUMENTS

| | | |
|---|---|---|
| 0064863 | 11/1982 | European Pat. Off. . |
| 2042857 | 2/1971 | France . |
| 2393637 | 1/1979 | France . |

*Primary Examiner*—L. Dewayne Rutledge
*Assistant Examiner*—S. Kastler
*Attorney, Agent, or Firm*—Young & Thompson

[57] ABSTRACT

An internal lining for protecting the permanent refractory lining of a metallurgical vessel (1, 2) such as a tundish, casting ladle or slag pot has a base of refractory inorganic particles coated with a binder. The protective internal lining is constituted by at least two layers, namely an inner layer (3) which sinters throughout its mass under the action of heat of the molten metal contained in the metallurgical vessel, and a layer (4 or 5) which does not sinter at all or sinters only to a partial extent in order to remain friable even when the inner layer (3) has completely sintered.

9 Claims, 1 Drawing Sheet

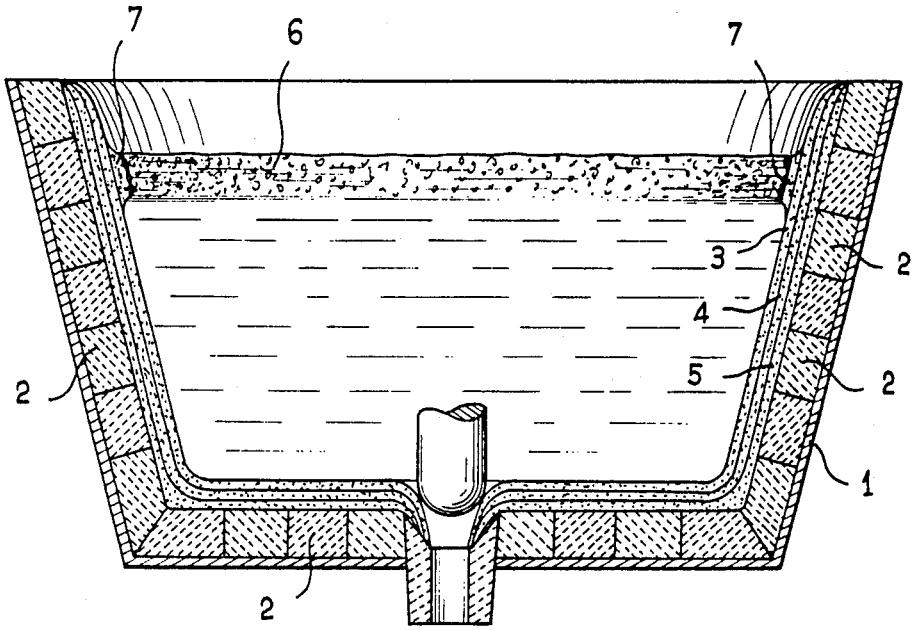
7
6
7
3
2
4
5
2
2
1
2

LINING FOR PROTECTING THE INTERIOR OF A METALLURGICAL VESSEL AND A METHOD FOR FORMING SAID LINING

BACKGROUND OF THE INVENTION

1. Field of the Invention

The present invention relates to a lining for protecting the interior of a metallurgical vessel which is intended to contain a molten metal such as liquid steel.

The invention is also directed to a method for forming a protective internal lining of this type.

The metallurgical vessel which it is desired to protect by means of an internal lining in accordance with the invention can be a casting ladle, a tundish or a slag vessel.

2. Description of the Prior Art

A metallurgical vessel of the type mentioned in the foregoing usually has an outer shell of steel provided with a lining of refractory material such as bricks of magnesia, alumina or aluminosilicate or of refractory cement.

At the end of the casting operation, it is necessary to remove the residues remaining within vessels which have contained the molten metal. These residues have a highly corrosive action on the lining of refractory material, with the result that the lining becomes worn in the course of time and has to be replaced at the end of a limited period of use. This replacement operation, however, is both complicated and costly.

Many solutions have already been proposed for providing the permanent refractory lining of metallurgical vessels with protection against corrosive wear.

French Pat. No. 2,316,027 advocates the protection of all the internal portions of a vessel or ladle for transfer of molten metals by interposing sinterable elements between the permanent refractory lining and the molten metal, these elements being usually provided in the form of plates.

French Pat. No. 2,393,637 describes a similar protection provided with or without the aid of prefabricated refractory insulating elements which are sinterable in contact with liquid steel, said elements being bonded to the permanent refractory lining by application of a composition which is substantially identical with that of the prefabricated elements aforesaid.

In French Pat. No. 2,451,789, the permanent refractory lining of a metallurgical vessel is protected by means of a relatively compressible layer between said permanent refractory lining and an internal lining which comes into contact with the liquid steel, said compressible layer being formed by a base of organic and/or inorganic fibers coated with a binder.

Another solution advocated in German Federal Republic patent application No. 2,010,743 consists in incorporating non-agglomerated sand beneath the prefabricated elements and behind these latter in order to increase the heat-insulation coefficient of the wearing lining which comes into contact with the liquid steel.

French Pat. No. 2,393,637 already cited in the foregoing also describes the possibility of applying, projecting or introducing the composition by means of a mold which leaves a uniform internal space between the mold and the wall to be lined, the composition being introduced into said uniform space by tamping and/or blowing, by suction or by vibration.

All these solutions are attended by many disadvantages.

Protective internal linings consisting of plates or prefabricated elements are relatively costly and complicated to instal. Furthermore, these plates or prefabricated elements do not usually afford resistance to more than five of six successive casting operations.

In order to avoid any hydrogen contamination of molten metal, it is necessary in some instances to preheat protective lining plates to a temperature above 600° C. in order to eliminate moisture as well as the organic compounds contained therein.

During the preheating process, the plates or prefabricated elements exhibit a tendency to buckle under the action of heat, thus forming gaps between the joints of said plates or elements, with the result that the molten metal is liable to seep through the gaps and thus to reach the permanent refractory lining.

This situation becomes even worse when the gap formed between the plates and the permanent refractory lining is filled with powdery material such as sand. In fact, this powdery material is liable to contaminate the molten metal as it flows through the gaps formed between the plates which have buckled under the action of heat. Furthermore, by seeping through these gaps, the molten metal mixes with the powdery material and thus forms a mass which strongly adheres to the permanent refractory lining, with the result that this permanent lining then becomes very difficult to clean.

The single-layer internal linings formed by projection of spray-coating as described in French Pat. No. 2,393,637 and obtained from a mixture of refractory inorganic particles and of an inorganic or organic binder are not attended by the above-mentioned disadvantages of plates or other prefabricated elements.

Internal linings of this type must necessarily sinter in contact with the molten metal in order to guard against any danger of detachment of inorganic particles from these internal linings since such particles would cause contamination of the molten metal.

The sintering process just mentioned takes place progressively and, after a certain period of contact between the molten metal and the protective internal lining, the entire mass of said lining is sintered, thus giving rise to the following two drawbacks:

in the first place, when the entire mass of the protective internal lining is sintered, this lining has appreciably lower heat-insulating power, with the result that there is a potential danger of cooling of the molten metal;

in the second place, when the entire mass of the internal lining has sintered, this mass adheres to the permanent refractory lining and this latter then becomes very difficult to clean.

For the two reasons just given, sintering of the protective internal lining is not allowed to proceed to completion. Thus, when the casting operation is completed, said internal lining can be detached in one piece from the internal walls of the metallurgical vessel simply by overturning the vessel.

In consequence, said protective lining can be used only for a few successive casting operations and therefore has to be replaced at frequent intervals. Each replacement is relatively costly and causes an interruption of the casting operation, which is also unfavorable from an economic standpoint.

In French Pat. No. 2,338,100, it has been proposed to place between the sinterable internal lining and the permanent refractory lining a material having a paper base, for example, in order to provide the possibility of limiting the risks of adhesion between the sintered internal lining and the permanent refractory lining. However, this material chars rapidly under the action of heat and is consequently incapable in practice of performing the function just mentioned.

The aim of the present invention is to overcome the disadvantages of the known solutions discussed in the foregoing by providing a protective internal lining which is both inexpensive, easy to instal, affords resistance to a large number of successive casting operations, withstands high preheating temperatures without damage, makes it possible to maintain a high heat-insulating power during a large number of successive casting operations, and effectively guards against any risk of adhesion between the protective internal lining and the wall of the metallurgical vessel, with the result that cleaning of the vessel on completion of the casting operation is considerably facilitated.

SUMMARY OF THE INVENTION

In accordance with the invention, the internal lining which has the function of protecting the interior of a metallurgical vessel for containing molten metal and which has a base of refractory inorganic particles coated with a binder is essentially constituted by at least the following two layers:

a layer having a composition and granular size of refractory inorganic particles which are such that said layer sinters throughout its mass under the action of the heat of the molten metal contained in the metallurgical vessel;

a layer having a composition and granular size of refractory inorganic particles which are such that said layer does not sinter or sinters only to a partial extent in order to remain friable even when the first layer has completely sintered.

The protective internal lining in accordance with the invention is thus made up of at least two distinct layers. One of these two layers sinters progressively until it is in contact with the molten metal. After a long period of contact, for example after about ten successive casting operations, said layer is sintered throughout its mass.

The other layer does not sinter or sinters only to a partial extent so as to remain friable even when the first layer has completely sintered. Thus, when said other layer is in contact with the permanent refractory lining, said layer does not adhere to said refractory lining. In consequence, any danger of adhesion between the protective internal lining and the refractory lining is avoided, even when the first layer has completely sintered. The result thereby achieved is that cleaning of the interior of the metallurgical vessel upon completion of the casting operation is a very easy operation and the refractory lining of said vessel is not liable to be damaged either while casting is in progress or at the time of cleaning.

It is also known that sintering of the protective lining has a detrimental effect on its insulating properties. Since the second layer does not sinter or sinters only to a partial extent, said second layer continues to ensure a sufficient degree of heat insulation, even when the first layer has completely sintered and consequently also has very low heat-insulating power.

By virtue of the association of two layers, one of which is sinterable whilst the other is partially sinterable or not sinterable, the useful life of the protective lining of a metallurgical vessel can be considerably extended, thus making it possible to avoid casting interruptions which are excessively long and frequent and consequently carry a heavy cost penalty.

It may thus be stated that, surprisingly, the useful life of a two-layer protective lining in accordance with the invention is distinctly longer than that of a protective lining formed of only one layer which is sinterable throughout its mass and has the same thickness as that of the two layers of the protective lining in accordance with the invention.

Sintering is the physico-chemical phenomenon whereby a bond is formed between two inorganic particles. The sintering process takes place at a temperature which is distinctly below the melting point of these particles. This process is facilitated by the high pressure exerted by the molten metal on the protective lining in accordance with the invention, by the possible presence within this lining of very fine particles, of fluxes (the fluxes being constituted by inorganic particles having a lower melting point than that of the other particles which are refractory) and by the use of a proportion of binder which is as small as possible in order to ensure that the inorganic particles are located in very close proximity to each other.

According to another aspect of the invention, the method for forming the protective internal lining in accordance with the invention consists in successively applying the different layers by making use of a slurry containing the solid ingredients of the layer to be formed, said solid ingredients being mixed with a liquid such as ethylene glycol alcohol and/or water in a proportion of 3 to 30% by weight of liquid, the density of said slurry being variable according to the layer between 0.8 and 3.5 kg/dm$^3$, whereupon the different layers are dried. This drying operation is performed at a temperature within the range of 100° to 200° C. in order to eliminate the free water. In some cases, the different layers are preheated to a temperature within the range of 600° to 1450° C. in order to eliminate the makeup water and/or crystallization water with a view to preventing any hydrogen contamination of the molten metal.

Application of the slurry is preferably carried out by projection and/or by spraying but can also be performed by other mechanical means such as molding, injection, vibration, gravity coating, troweling or any other suitable method.

The method in accordance with the invention is both highly economical and perfectly suited to the application of successive layers having different compositions.

DETAILED DESCRIPTION OF THE INVENTION

Other features of the invention will be more apparent to those versed in the art upon consideration of the description which now follows. Reference will be made to the single accompanying FIGURE which is a transverse sectional view of a protective internal lining in accordance with the invention. In the example illustrated, the protective lining is made up of three superposed layers applied internally and located within an intermediate casting vessel known as a tundish.

In the embodiment shown in the FIGURE, the tundish which is intended to contain liquid steel has an external steel shell 1 provided on its internal faces with a permanent refractory lining composed of refractory bricks 2.

A protective internal lining is applied on said permanent refractory lining in the form of a slurry. In the example illustrated, said protective lining is made up of three layers 3, 4, 5.

The inner layer 3 which is intended to come into contact with the molten metal as this latter is poured into the tundish is formed by a mixture of refractory inorganic particles bonded together by means of an organic and/or inorganic binder. The composition of these inorganic particles and their effective size are such that said particles are capable of sintering or in other words of fusing together so as to form a coherent mass in contact with the molten metal.

Sintering in contact with the molten metal takes place very progressively until it finally reaches the entire thickness of the layer 3 or in other words is completed throughout the mass of said layer at the end of a period of contact which usually corresponds to several hours and to several successive casting operations.

It will be clearly apparent that, as the thickness of said layer 3 is greater, to the time taken to achieve complete sintering of said layer throughout its mass will be of longer duration. The thickness of said layer 3 is usually within the range of 1 to 10 cm.

The intermediate layer 4 is also formed by a mixture of inorganic particles bonded together by means of an organic and/or inorganic binder. The composition and effective size of these particles are such that said particles sinter only to a partial extent with a view to ensuring that said layer 4 remains friable, even when the inner layer 3 is completely sintered throughout its mass. The thickness of said layer 4 is usually of the same order of magnitude as that of the layer 3.

The layer 5 is in direct contact with the lining of refractory bricks 2. Said layer 5 is also formed by a mixture of refractory inorganic particles bonded together by an organic and/or inorganic binder. However, in contrast to the other layers 3 and 4, the layer 5 is not sinterable. In consequence, when the organic or inorganic binder which ensures initial cohesion of said layer has been destroyed under the action of heat, said layer 5 becomes powdery and no longer adheres to the lining of refractory bricks 2.

The layers 3 and 4 which are respectively sinterable and partially sinterable preferably have the following composition by weight:

Mineral binder (for example boron and/or boric acid and/or clay and/or one or a number of silicates and/or aluminous cement and/or phosphate cement and/or magnesia cement and/or organic binder and/or synthetic binder (for example a synthetic adhesive such as phenolic resin) . . . 0.3 to 15%

Refractory inorganic particles in the form of grains and/or fibers (for example chrome-magnesia and/or magnesia and/or magnesia silicate and/or alumina and/or zircon and/or zirconia and/or silica . . . 70 to 99.7%

Organic particles and/or carbonaceous materials in fibers and/or in grains . . . 0 to 28.7%

Surfactant compound . . . 0 to 5%

The more or less sinterable character of the layers 3 and 4 depends on the nature and composition of the refractory inorganic particles, on the effective size of the particles, on the possible presence of fluxes such as iron oxide or carbonate of alkali metals or alkaline-earth metals and on the percentage content of binder.

In order to ensure complete sintering of the layer 3 in contact with the molten metal, it will be preferable to employ a composition containing a large proportion of refractory inorganic particles. Thus the weight concentration of these particles will preferably be within the range of 70 to 99.7% with a particle size preferably within the range of 0 to 4 mm. This postulates that a certain number of particles are of very small size, which produces a favorable effect on the sintering process.

The intermediate layer 4 contains a proportion of refractory inorganic particles which is smaller than that of the completely sinterable layer 3. This proportion is preferably within the range of 75 to 95% by weight. The effective size or particle diameter is advantageously between 0 and 3 mm preferably between 0.25 to 2.5 mm, with the result that the very small particles having a diameter of less than 0.5 mm are absent from this composition in order to limit the sintering process. Said layer 4 can thus sinter only to a partial extent while thus remaining friable or in other words brittle, even when the layer 3 has completely sintered throughout its mass.

By reason of the fact that said intemediate layer 4 sinters only to a partial extent, said intermediate layer retains its heat-insulating properties and consequently makes it possible to prevent cooling of the molten metal even when the inner layer 3 has completely sintered and has thus lost its initial heat-insulating properties.

The layer 5 which is adjacent to the permanent refractory lining 2 preferably contains between 65 and 96% by weight of refractory inorganic particles having a diameter which is preferably within the range of 0 to 5 mm. By reason of its lower concentration of refractory inorganic particles, and by reason of the fact that it is separated from the sinterable layer 3 by a heat-insulating intermediate layer 4, the outer layer 5 does not sinter under the action of heat, thus entirely loosing its cohesion and becoming powdery after destruction of the binder which initially ensured its cohesion. Thus, when it is considered after a large number of successive casting operations that the protective internal lining in accordance with the invention is sufficiently worn and that it should accordingly be replaced by a new lining, the procedure involved is simple: since the layer 5 adjacent to the permanent refractory lining 2 is in a powdery state, there is no adhesion between said permanent lining and the protective lining assembly which can consequently be detached from the permanent lining in a single piece and with great ease, simply by turning the tundish upside-down.

In consequence, the protective lining in accordance with the invention not only provides efficient protection of the permanent refractory lining 2 but makes it possible to clean the interior of the tundish with great ease.

In order to carry out the method in accordance with the invention and to form a protective lining having three layers 3, 4, 5 as described in the foregoing, these layers are successively applied on the tundish walls in the form of a slurry containing the solid ingredients of said layers, said ingredients being mixed with a liquid such as water and/or oils in a proportion of 3 to 30% by weight of liquid. An alcohol would also be suitable (ethylene glycol, for example).

When it is applied, the slurry must have a sufficiently paste-like consistency without running.

The density of the applied slurry varies according to the layers 5, 4, 3 between 0.8 kg/dm$^3$ and 3.5 kg/dm$^3$, the density of the inner layer 3 being greater than that of the intermediate layer 4 and the density of this latter being greater than that of the layer 5 which is adjacent to the refractory lining 2.

The layers 3, 4, 5 thus applied are then dried at a temperature within the range of 100° to 200° C., for example by flame-drying and/or blowing of hot air, or else by means of electric heating resistors placed within the tundish and attached to a cover which closes this latter. The drying operation makes it possible to eliminate the free water from the slurry which forms the different layers.

It is useful in some cases to remove all the organic constituents and the entire quantity of makeup water and crystallization water from the layers 3, 4, 5 in order to guard against any danger of hydrogen contamination of the molten metal. To this end, the layers 3, 4, 5 are preheated to a temperature within the range of 600° C. to 1450° C.

At these high temperatures the inorganic and/or organic binders used for initial cohesion of the layers 3, 4, 5 are decomposed. This heating to a high temperature has the effect of partial sintering of the inner layer 3. This partial sintering process makes it possible to restore cohesion of the protective lining as a whole. As a result of this cohesion, the inorganic particles are prevented from becoming detached from the protective lining and contaminating the molten metal when this latter is poured into the tundish.

In comparison with a conventional applied lining of a sinterable single-layer type having a composition which is similar to that of the inner layer 3 of the protective lining in accordance with the invention, this lining offers unexpected technical advantages in respect of the same total thickness.

In the first place, the protective lining in accordance with the invention has a distinctly longer service life by reason of the fact that the sintering process practically does not continue beyond the inner layer 3 and therefore cannot reach the permanent refractory lining 2.

In the second place, since the intermediate layer 4 sinters only to a partial extent and the layer 5 adjacent to the permanent refractory lining 2 does not sinter at all, those layers 4 and 5 ensure excellent heat insulation, thus preventing any cooling of the molten metal while it remains within the tundish.

In the third place, by virtue of the fact that the layer 5 adjacent to the permanent refractory lining 2 does not sinter and becomes powdery and that said layer 5 does not have any power of adhesion to said permanent lining, removal of the protective lining on completion of a casting operation can be carried out with great ease. There is thus no danger of causing damage to the permanent refractory lining by making use of tools such as pneumatic drills in an endeavor to remove solidified masses which have adhered to said permanent refractory lining.

It will be readily apparent that the invention is not limited to the example of construction described in the foregoing. Any number of modifications may accordingly be contemplated without thereby departing either from the scope or the spirit of the invention.

From this it follows that, in a simplified embodiment of the invention, one of the layers 4 or 5 may be dispensed with so as to limit the number of layers to at least two.

When the sinterable inner layer 3 is separated from the permanent refractory lining 2 by the unsinterable layer 5, there is again no attendant danger of adhesion between said layer 5 and the permanent refractory lining 2. However, the heat-insulating power provided by these two layers will clearly be lower than in the case of a protective lining which has three layers.

When the sinterable inner layer 3 is separated from the permanent refractory lining 2 by the layer 4 which sinters only partially and consequently remains friable, there is at most a danger of slight adhesion between said layer 4 and the refractory lining 2.

Moreover, in the case of a protective lining made up of three layers, it is possible to place the unsinterable layer 5 between the sinterable layer 3 and the partially sinterable layer 4.

Furthermore, in the event that slight contamination of the molten metal by inorganic particles originating from the protective lining should be found acceptable, the layers 3 and 4 can be reversed by placing the sinterable layer 3 between the unsinterable layer 5 and the partially sinterable layer 4.

It is also possible by means of the method in accordance with the invention to apply an overthickness 7 of the sinterable layer 3 opposite to the zone of supernatant slag 6 which floats at the surface of the molten metal. This overthickness 7 can have the same composition as the layer 3 in order to sinter at the same time as this latter. Said overthickness 7 serves to enhance the protection provided by the internal lining in accordance with the invention in the slag zone which is the most vulnerable zone of the tundish.

The above-mentioned overthickness 7 can also have a composition which is different from that of the layer 3 in order to ensure a higher degree of protection with respect to the slag. The composition of the layer forming this overthickness 7 can thus contain highly refractory particles of material such as zircon and/or zirconia and/or carbon and/or silicon carbide.

As can readily be understood, the thickness of the protective lining may also be increased at other tundish locations and to a partial extent within the zone of impact of the stream of molten metal which is poured from the casting ladle placed above the tundish.

Practical experiences has shown that it is also possible to apply the different layers by means of a trowel or by molding.

What is claimed is:

1. A tundish to be filled with molten metal, comprising a metal casing having a permanent refractory lining, the permanent lining having a temporary destructible refractory lining having an inner surface exposed to the interior of the tundish, said temporary lining being constituted by at least two layers of predetermined compositions and granular sizes applied one above the other in the interior of the tundish in the form of a slurry containing refractory inorganic particles, a binder, and a liquid, one of said layers being, when the tundish is filled with molten metal, in contact with said molten metal and the other layer being in contact with the permanent lining, said one layer having a predetermined composition and granular size of refractory inorganic particles which are such that said one layer is able to sinter throughout its mass under the action of the heat of the molten metal contained in the tundish, and said other layer having a predetermined composition and granular size of refractory inorganic particles which differ from both the composition and the granular size of particles of said one layer such that said other layer does not sinter or sinters only to a partial extent in order to remain friable even when said one layer has completely sintered.

2. A tundish according to claim 1, wherein said temporary lining is constituted by three layers as follows:

a layer (3) which, when the tundish is filled with molten metal, is in contact with said molten metal and is capable of sintering throughout its mass in contact with said molten metal;

an intermediate layer (4) covered by the above layer and formed of material which sinters only to a partial extent and remains friable even when said above layer is sintered throughout its mass; and a layer (5) in direct contact with said permanent lining and formed of unsinterable material which becomes powdery under the action of the heat.

3. A tundish according to claim 2, wherein the first-mentioned layer (3) contains 70 to 99.7% by weight of refractory inorganic particles having a granular size up to 4 mm.

4. A tundish according to claim 2, wherein said intermediate layer (4) contains 75 to 95% by weight of refractory inorganic particles having a granular size within the range of 0.25 to 2.5 mm.

5. A tundish according to claim 2, wherein the unsinterable layer (5) which becomes powdery contains 65 to 96% by weight of refractory inorganic particles having a granular size up to 5 mm.

6. A tundish according to claim 1, for use with molten metal covered with a layer (6) of slag, an overthickness (7) of the layer which is intended to sinter completely in contact with the molten metal being formed at the level of said slag layer.

7. A tundish according to claim 1, wherein said one layer has the following composition by weight:

binder which is at least one member selected from the group consisting of clay, silicates, aluminous cement, phosphate cement, magnesia cement and organic binder in the form of a synthetic adhesive . . . 0.3 to 15% refractory inorganic particles in the form of grains and/or fibers which are at least one member selected from the group consisting of chrome-magnesia, magnesia, magnesium silicate, silica, alumina, zircon and zirconia . . . 70 to 99.7% a member selected from the group consisting of organic particles and carbonaceous materials in fibers or in grains . . . 0 to 28.7% surfactant compound . . . 0 to 5%.

8. A method for forming a temporary destructible protective lining for a tundish to be filled with molten metal, the tundish comprising a metal casing having a permanent refractory lining, the temporary lining comprising an internal lining for protecting the permanent lining, wherein said temporary lining is constituted by at least two layers applied in the interior of the tundish in the form of a slurry containing refractory inorganic particles, a binder, and a liquid, one of said layers being, when the tundish is filled with molten metal in contact with said molten metal, and the other layer being in contact with the permanent lining, said one layer having a predetermined composition and granular size of refractory inorganic particles which are such that said layer sinters throughout its mass under the action of the heat of the molten metal contained in the tundish, and said other layer having a predetermined composition and granular size of refractory inorganic particles which differ from both the composition and the granular size of the particles of said one layer such that said other layer does not sinter or sinters only to a partial extent in order to remain friable even when said one layer has completely sintered, which method comprises applying the different layers (5, 4, 3) successively in the form of a slurry containing the solid ingredients of the layer to be formed, said solid ingredients being mixed with a liquid in a proportion of 3 to 30% by weight of liquid, the density of said slurry being variable within a range of 0.8 to 3.5 kg/dm$^3$, and drying the different layers (5, 4, 3) at a temperature within the range of 100° to 200° C.

9. A method as claimed in claim 8, in which said layers are successively applied by spraying.

* * * * *